US006686680B2

(12) United States Patent
Shaw et al.

(10) Patent No.: US 6,686,680 B2
(45) Date of Patent: Feb. 3, 2004

(54) METHOD AND APPARATUS FOR REGULATING ELECTRON EMISSION IN FIELD EMITTER DEVICES

(75) Inventors: Jonathan L. Shaw, Springfield, VA (US); David S. Y. Hsu, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/340,669

(22) Filed: Jan. 13, 2003

(65) Prior Publication Data

US 2003/0132714 A1 Jul. 17, 2003

Related U.S. Application Data

(60) Provisional application No. 60/347,883, filed on Jan. 15, 2002.

(51) Int. Cl.[7] ..... H01J 1/02; H01J 21/10

(52) U.S. Cl. ..... 313/309; 315/169.1

(58) Field of Search ..... 315/169.1, 224, 315/169.3, 337; 313/309, 336, 351, 310, 307, 308, 333, 346, 495

(56) References Cited

U.S. PATENT DOCUMENTS 5,070,282 A 12/1991 Epsztein
5,097,231 A * 3/1992 Johnson et al. ..... 333/13
5,162,704 A 11/1992 Kobori et al.
5,186,670 A 2/1993 Doan et al.
5,442,255 A * 8/1995 Ise et al. ..... 313/495
5,955,849 A 9/1999 Tang et al.
6,169,371 B1 * 1/2001 Zimlich et al. ..... 315/169.1
6,204,596 B1 * 3/2001 Macaulay et al. ..... 313/310

* cited by examiner

*Primary Examiner*—James Clinger
*Assistant Examiner*—Chuc Tran
(74) *Attorney, Agent, or Firm*—John J. Karasek; Stephen T. Hunnuis

(57) ABSTRACT

An apparatus and method for regulating the emission current from a single (macroscopic) field emitter, from groups of emitters within a large (microscopic) array, or from each cell within an array is described. The apparatus includes an additional aperture, fabricated at each field emitter array cell, to create and electron energy filter. The filter aperture of the electron energy filter is similar to the gate aperture but located above or in front of the gate aperture, and is held at a positive potential lower than the gate. The filter allows only those electrons with energy greater than some minimum (the cutoff energy) to pass through. A current-limiting circuit is placed in series with the gate aperture, limiting the total current of electrons that do not pass through the filter. Thus, emission from low energy states is limited without limiting emission from states near the Fermi level.

40 Claims, 6 Drawing Sheets

METHOD AND APPARATUS FOR REGULATING ELECTRON EMISSION IN FIELD EMITTER DEVICES

CROSS-REFERENCE TO RELATED APPLICATIONS

This application is a utility application of commonly assigned Provisional Application No. 60/347,883, filed on Jan. 15, 2002, and is entitled to benefit of the Jan. 15, 2002 filing date for the matter disclosed therein, and the entire contents of which are incorporated herein by reference.

BACKGROUND OF THE INVENTION

1. Field of the Invention

The present invention generally relates to electron emission devices. More particularly, it relates to a method and apparatus for improving the performance of field emitter devices by detecting the emission of electrons at excessively positive potentials and regulating the current produced at the excessively positive potentials.

2. Description of Related Art

Field emission is a tunneling process where electrons move from a solid, through a thin potential barrier, into vacuum without changing energy. The field emitted current increases as a function of the electric field at the emitter surface. A macroscopic field emitter tip requires a voltage typically greater than 100V and often more than 1000V to cause emission. The electronic, chemical, and geometric properties of the emitter surface also have a substantial effect on the field emission current. These properties can change as a result of field emission, especially when adsorbed and reacted atoms are present on the emitting surface.

When electrons tunnel from states at energies below $E_F$, electronic energy is released as the empty state is filled. If this electronic energy is large enough and is directly coupled to chemical bonds, the bonds can break, thus releasing atoms to the vacuum, stimulating atomic motion on the surface, and/or causing chemical reactions. Chemical bonds typically have energies of 2–5 eV, so emission from energies more than 2 eV below $E_F$ can potentially stimulate these changes.

A similar electronic mechanism occurs when positive charge and very high local electric fields are created as electrons tunnel out of insulating or semi-conducting material. If the electric fields become too high, local breakdown may result. The field emission characteristics of each emitter typically change continuously during operation as a result of this electronic excitation. If atoms are released into vacuum as a result, arcs can occur at the field emission site.

Such arcs release the energy stored in the charged capacitance formed by the high voltage emitter, potentially causing significant physical damage. Although the probability of direct coupling to a bond may be low, it is possible that filling a single low energy state could break a bond. In contrast, large current densities are typically required to heat the emitter to a point where bonds may be broken. Thus, the emission current required to cause such thermal effects is often much higher than the currents at which failures are found to occur.

The electronic energy released after tunneling increases as the energy of the initial state becomes more positive (lower electron energy). Cleaning a metallic emitter surface of foreign atoms (and keeping it clean during operation) typically reduces the low energy emission and increases the maximum emission current which can be produced without causing an arc. Cleaning can be accomplished by heating the emitter to very high temperature in ultra high vacuum or by applying a very large negative electric field so as to field-desorb the surface atoms.

Cleaning may also occur spontaneously during emission because of the electronically-stimulated reactions mentioned above, or due to bombardment by ions created by the emitted electrons. However, subsequent contamination generally occurs within a few hours or minutes even when the emitter is maintained in ultra-high vacuum.

Field emitter arrays are micro-fabricated arrays of many small field emission structures (cells) and are known in the art. Each individual cell includes an emission site on the substrate and an aperture in a conducting layer (called the gate) deposited over a dielectric layer. The size of the apertures is typically about 1 micron, but may be much smaller. The distance between cells is typically 3–4 times the aperture diameter, but may be larger. A large electric field is created at the emission site when a positive voltage is applied to the gate with respect to the emitter.

An FEA typically requires an emitter-gate voltage of at least 10V and sometimes more than 100V to cause emission. In many applications, operation of the arrays must occur in relatively poor vacuum, and most arrays cannot be heated to temperatures high enough to remove adsorbed surface atoms. Thus, emission typically occurs from surfaces covered with adsorbed atoms, and the electronic properties of the adsorbed atoms frequency dominate the emission properties.

Because the area of a single cell is small compared to the area required to make an external connection, only a limited number of connections to the array are practical. Thus, in typical state of the art arrays a large number of cells (~10,000) share the same electric connection to an external voltage source.

Ideally, the field emitter arrays would be able to provide total currents nearly equal to the number of cells in the array multiplied by the current a single cell can produce. However, the cells typically do not have uniform emission properties and will fail if the emission current is excessive. Thus, only a small number of cells contribute to the emission current, so the arrays do not produce nearly as much current as they might if the emitters were more uniform.

The emission current can also vary with time and from place to place over the array as a result of spatial and temporal non-uniformity in the physical and chemical properties of the emitting sites. This variation is undesirable for many applications.

One known method of forcing the emission currents from each of the individual cells in an array to be more equal is to place a current-limiting circuit element, typically a resistance, in series with each emitter. If the resistances are large enough, the voltages developed across the resistors dominate the emission properties of each cell. Thus, the emission current can be nearly as uniform from cell to cell as are the resistances. This sort of scheme is workable for some applications such as displays requiring relatively small current densities and frequencies.

However, the voltages developed across the resistors change the energy of the emitted electrons, increasing the energy distribution (energy spread) of the beam, which is undesirable for many applications. The resistors also reduce the transconductance (dI/dV) and frequency response of the arrays. Although more complex current-limiting circuits can reduce such problems, any circuit that changes the potential of the emission site will increase the energy spread of the emitted electron beam.

FIG. 1 shows a cross sectional view of a single cell within a prior art field emitter array (FEA). Although a single cell is shown herein for the sake of simplicity, an overall FEA includes many of these cells, fabricated in a planar array. An emitter structure 3 is created on a conductive substrate 2 (or a conductive layer on an insulating substrate) in such a way that when a voltage source 12 is connected between the conductive gate layer 8 and the substrate 2, a field emission current is induced at the emission sites 4 of the emitter 3.

The emitter structure 3 is often pointed in shape in order to create a region of enhanced electric field at the intended emission site. The gate layer 8 is separated from the substrate 2 by an insulating layer 6, such as, for example, silicon dioxide. Normally, the emission current passes through a first aperture 10 (hereinafter "gate aperture 10") and is collected at a location having a potential of at least several volts more positive than the emission site. The diameter of the gate aperture 10 is typically on the order of 1 micron. To ensure that most of the field emission current passes through the gate layer 8, the gate layer 8 is preferred to have rotational symmetry about a vertical axis, and the emission site 4 is preferred to be located on the axis of symmetry.

In order to make the electric field at the emission site 4 relatively independent of the voltages applied to external electrodes, the exposed face of the gate aperture 10 facing the emitter 3 is preferred to have a thickness similar to the diameter of the gate aperture 10. In some exemplary cases, the emission site 4 is fabricated on a resistive film, creating resistance 14 between the external voltage supply 12 and the emitter 3. The current passing though the resistor 14 creates a voltage opposite the external supply 12, reducing the voltage between the gate layer 8 and emission site 4, thus limiting the emission current.

FIGS. 2 and 3 show exemplary energy distributions measured from typical field emitters as shown in FIG. 1. FIG. 2 is an exemplary energy distribution graph produced by a typical single macroscopic field emitter made from molybdenum wire, operated after being exposed to air. The energy distribution extends to more than 2 eV below the Fermi level ($E_F$), and most of the additional emission current induced by increasing the emitter-gate voltage occurs at the lower part of the energy range. In this example, all of the additional emission measured with gate voltages above 850V occurs at least 1 eV below $E_F$.

FIG. 3 shows an exemplary energy distribution chart created by a typical field emitter array with emitter structures made from n-type silicon. Much of the additional current produced by increasing the gate voltage from 65 to 75 volts occurs at energies more than 2 eV below $E_F$.

Accordingly, a method and apparatus for regulating electron emission in field emitter devices overcoming the above-identified drawbacks is proposed.

SUMMARY OF THE INVENTION

A method and apparatus for regulating the emission current from a single (macroscopic) field emitter, from groups of emitters within a large array, or from each cell within an array is described. The apparatus of the present invention includes an additional aperture (filter aperture), fabricated at each field emitter array cell, to create an electron energy filter. The filter aperture of the electron energy filter is preferably similar to the gate aperture but located above or in front of the gate aperture, and is held at a positive potential that is lower than the potential applied to the gate.

The combination of the filter aperture and the filter electrode (referred to herein as an "energy filter") allows only those electrons with energy greater than a predetermined minimum (the cutoff energy) to pass through. A current-limiting circuit is placed in series with the gate aperture, limiting the total current of electrons that do not pass through the energy filter. Thus, emission from low energies is limited without limiting emission from energies near the Fermi level.

The cutoff energy (measured with respect to the Fermi level ($E_F$) of the substrate contact) is approximately equal to the voltage applied between the substrate and the filter aperture, minus the work function of the filter aperture. The physical dimensions of the filter aperture and adjacent electrodes determine the filter function. The filter function should ideally have a nearly abrupt step from fully transparent to fully opaque at the cutoff energy. In practice, the transition from transparent to opaque can occur in about 1 eV. The cutoff energy can be adjusted by changing the voltage applied to the energy filter. Electrons with energy that is too low to pass through the filter aperture are rejected and are reflected back to be collected by the gate electrode.

An electrical circuit connected to the gate aperture is used to reduce the voltage applied to the gate aperture until the gate current falls below an acceptable level. In this way, only the current which is emitted at excessively low energies is limited. However, the emission will not be limited if it occurs above the cutoff energy. In most cases the current emitted at low energies will naturally increase as the gate voltage is increased, such that the energy filter will begin to reject some of the current.

In cases where failures occur as a result of excessive low energy emission, the low energy emission can be reduced, thereby preventing such failures. In cases where a constant proportion of the emission occurs at low energies, the total emission current from each cell may be regulated to a constant value. These functions may be performed individually for each cell in the array. Alternatively, current limiting circuits can be connected to groups of cells within the array, to the entire array, or to combinations of individual cells, groups of cells, and the entire array.

A small resistance or other circuit element may be placed in series with the emitters to artificially increase the emission energy dispersion with emission current, thereby enhancing the functionality of the energy filter. This approach would be useful in cases where the energy filter function is too broad to detect the natural emission energy dispersion with emission current. The voltage developed across the series resistance should preferably be at least as large as the range of the filter cutoff energy, which might be approximately 1V. This is a smaller voltage than would typically be required to regulate the emission without the energy filter. The resistor may be fabricated in the form of a thin resistive film or resistive post.

Thin resistor films oriented perpendicular to the direction of current flow may be preferred in applications requiring high frequency emission modulation, as they form a capacitance in parallel with the resistance. The parallel capacitance reduces the impedance of the circuit at high frequencies. Such a structure is useful as it enables the displacement current associated with high frequency modulation of the electric field at the emitter surface to exceed the emission current.

The emission energy distribution may be determined by measuring emission current while varying the filter cutoff energy. This may be useful in cases where the emission energy distribution changes over time as a result of changes in the properties of the emitting surface.

No resistors or other circuits need preferably be connected to the filter aperture, hence the filter energy can be modulated at high frequencies. Changing the filter voltage from just below the minimum emitted energy to just above the maximum emitted energy will modulate all the current allowed to pass through the filter aperture. If the field emitters produce most of the current within a narrow energy range, the modulation voltage applied to the energy filter can also be small. Similarly, if a part of the emission occurs within a narrow energy range near $E_F$, the filter energy can be modulated in a narrow range near $E_F$, allowing a fraction of the total emission current to pass through the filter aperture.

One may describe the filter transconductance associated with modulating the filter voltage, distinct from the gate transconductance associated with modulating the gate voltage. The filter transconductance may be substantially larger than the gate transconductance. Thus, the power required to modulate the current that passes through the filter aperture may be substantially lower than the power required to modulate the emission current by changing the gate voltage. The current diverted to the gate may reduce the gate voltage due to the current limiting circuit, which can further improve the overall transconductance by combining the effect of modulating the filter and gate.

The circuit limiting the gate current can be a simple resistor or a more complex circuit including, for example, capacitors, diodes, or transistors. In an exemplary embodiment, the gate layer can create the resistance by fabricating the gate from a resistive material and patterning it to increase the resistance in series with each cell. In another embodiment, a resistive layer can be formed over the exposed surface of the gate aperture by deposition or chemical reaction.

In yet another embodiment, a circuit including a transistor can be fabricated by placing a semiconducting material at the exposed face of the insulating layer separating the gate from the substrate, such that electrons rejected by the filter will strike the semiconductor surface, thereby inducing conductivity in the semiconductor. Alternatively, the insulating layer(s) separating the substrate and gate, and/or gate and filter may be made entirely from an undoped (resistive) semiconductor so that its exposed face becomes less resistive under electron bombardment. The conducting gate and filter layers may be made from doped (conducting) layers in the same semiconducting material.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE EXEMPLARY EMBODIMENTS

Figure 1:
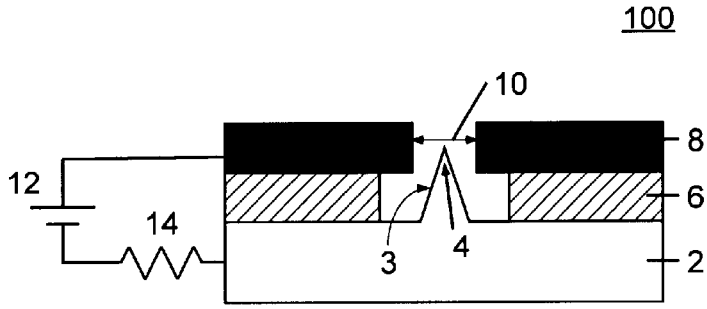
FIG. 1 (prior art)
FIG. 1 shows a cross sectional view-of a single cell within a prior art field emitter array (FEA)
Figure 2:
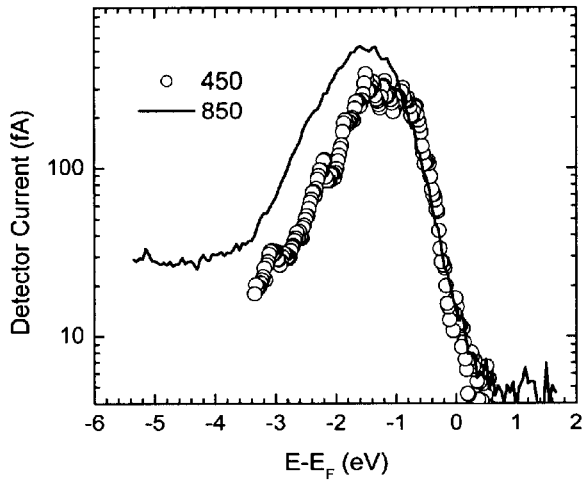
FIG. 2 (prior art)
FIG. 2 shows an energy distribution graph produced by a typical single macroscopic field emitter made from molybdenum wire.
Figure 3:
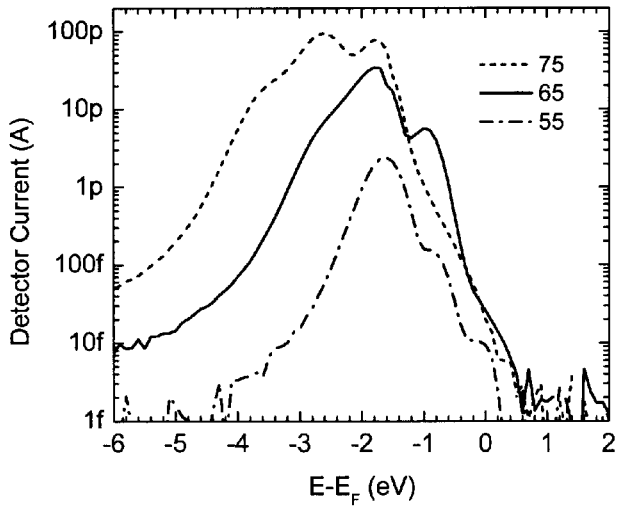
FIG. 3 (prior art)
FIG. 3 shows an energy distribution graph created by a typical field emitter array with emitter structures made from n-type silicon.
Figure 4:
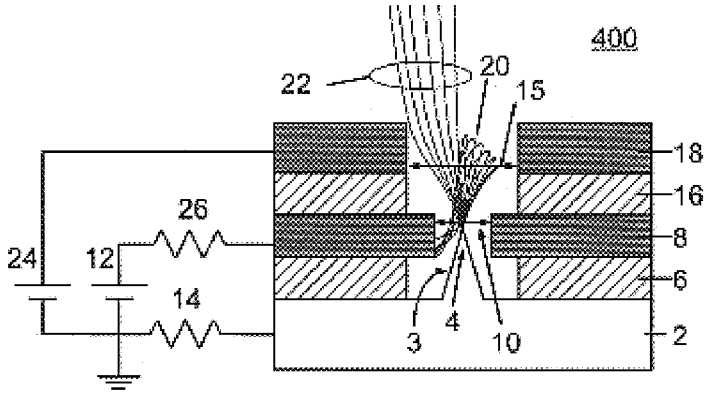
FIGS. 4, 4*a* through 4*g* show a cross-sectional view of a single cell within a field emitter array equipped with a filter aperture in accordance with an exemplary embodiment of the present invention.

Referring to FIG. 4, there is shown a cross-sectional view of a single field emission cell from a field emitter array (FEA) having a filter aperture in a preferred embodiment of the invention. A single FEA cell 400 is shown and described in FIG. 4, although the overall FEA may include many of the FEA cells, fabricated in the form of a planar array.

A second aperture 15 (hereinafter "filter aperture 15") is provided in a conductive layer 18 (alternately referred to as "filter electrode") separated from the gate layer 8 by a dielectric layer 16. The electric potential in a center region of the filter aperture 15 is controlled by the voltage 24 applied to the conductive layer 18. Electrons with energies greater than the vacuum level inside the filter aperture 15 are permitted to pass through the filter aperture 15.

The trajectories 22 shown on the left side of FIG. 4, are examples of transmitted electrons. Electrons having energies below the vacuum level inside the filter aperture 15 are rejected and are collected by the gate layer 8. The trajectories 20 shown on the right side are examples of reflected electrons. Current collected at the gate aperture 10 causes a voltage to appear across the resistance 26, thereby reducing the electric potential at the gate aperture 10 and so reducing the electric field at the emission site 4.

The conductive layer 8 (also referred to as gate layer 8), or portions of it, may be fabricated from resistive materials, used to create resistance 26 between the exposed surface of the gate aperture 10 and the external gate voltage supply 12. It will be appreciated that the resistance 26 may be adjusted by patterning the gate layer 8, especially when a group of emitter structures are connected to a single resistor. In some exemplary cases, the emission site 4 may be fabricated on a resistive film or other resistive structure, creating a resistance 14 between the external voltage supply 12 and the emitter 3.

Figure 4A:
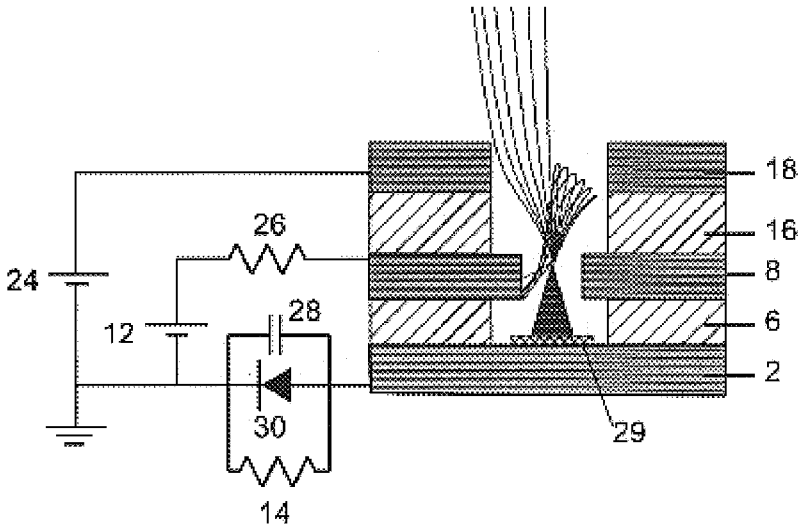
Figure 4B:
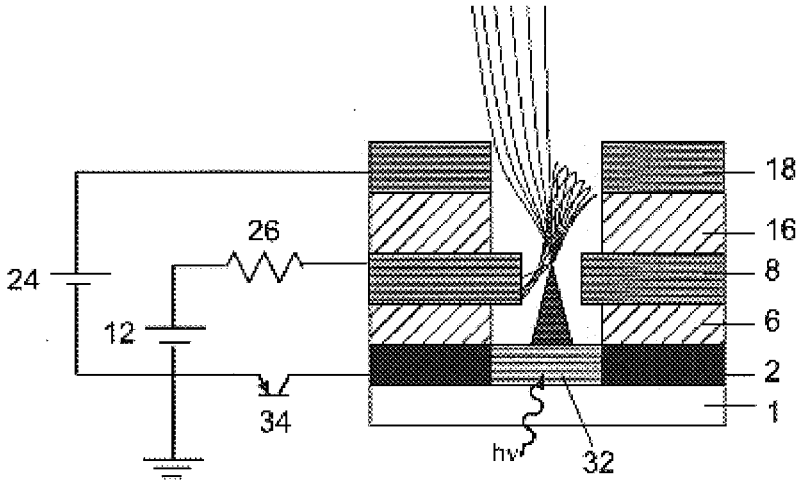

FIG. 4*a* shows a capacitor 28 and diode 30 in parallel with resistance 14, all located between the emission site 4 and circuit ground. These circuit elements may be easily formed at the interface of two dissimilar materials, such as a metal and a semiconductor, for example, as shown at 29. FIG. 4*b* shows a photosensitive material 32, forming photo-sensitive element 34. In this case, the FEA (and hence the photosensitive material 32) may be formed on a substrate material 2 which is transparent to light in a range of wavelengths which will activate the photosensitive element. In the exemplary embodiment of FIG. 4*b*, the photosensitive element is shown as a transistor. However, it is also possible to form photosensitive resistors and diodes. The voltage developed at the circuit element(s) in series with the emitter tip (resistance 14, capacitor 28, diode 30, or photo-sensitive element 34) will cause the electric potential at the emission site to change with emission current. This potential change need be only a few volts or less in order to be detected by the energy filter, according to the properties of the energy filter.

It will be appreciated that the need to develop a relatively low voltage of one or a few volts at these circuit elements in series with the emitter is advantageous. The advantages are in ease of fabrication and improved emitter performance. In order to make a significant change in the emission current without the addition of an energy filter and feedback circuit, the voltage developed in series with the emission site 4 would have to be a substantial fraction of the gate voltage. Since in some cases the gate voltage required to operate the emitter 3 may be several tens of volts, similar voltages will appear at the circuit elements during operation. This large voltage requires that the circuit elements have a minimum size according to the maximum electric field that they can sustain. In contrast, electric potentials of one or a few volts can be sustained much more easily. Furthermore, the various voltages that appear at the individual circuit elements will broaden the energy distribution of the overall emitter array, degrading the electron-optical quality of the beam.

Figure 4C:
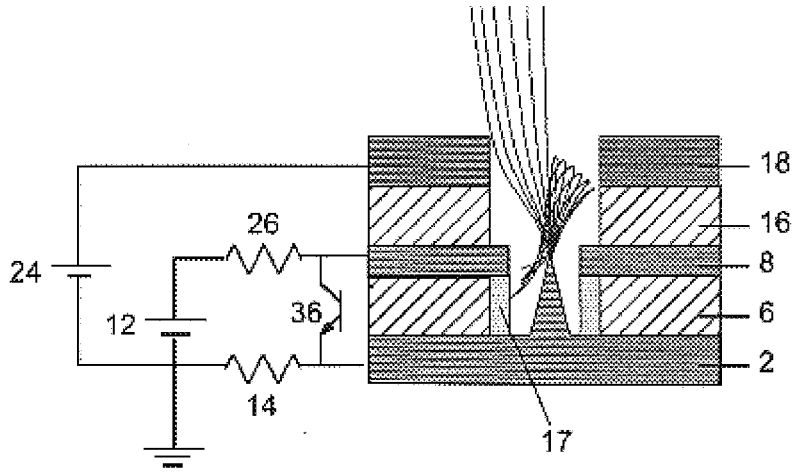

FIG. 4*c* shows a transistor circuit element 36, formed from a semiconducting material 17 formed at the surface of the dielectric layer 6 separating conductive layers 8 and 2. Transistor 36 creates a resistance between the conductive layers 2 and 8, the resistance being reduced when electrons impact the transistor. The material 17 might thus be a p-type or undoped semiconductor. The transistor 36 should exhibit current gain, such that a larger current may flow through the transistor than the current of vacuum electrons impacting it. In this way, the current which flows through resistor 26 will be larger than it would have been without transistor 36, allowing the value of resistor 26 to be lower in order to create a given potential change.

Figure 4D:
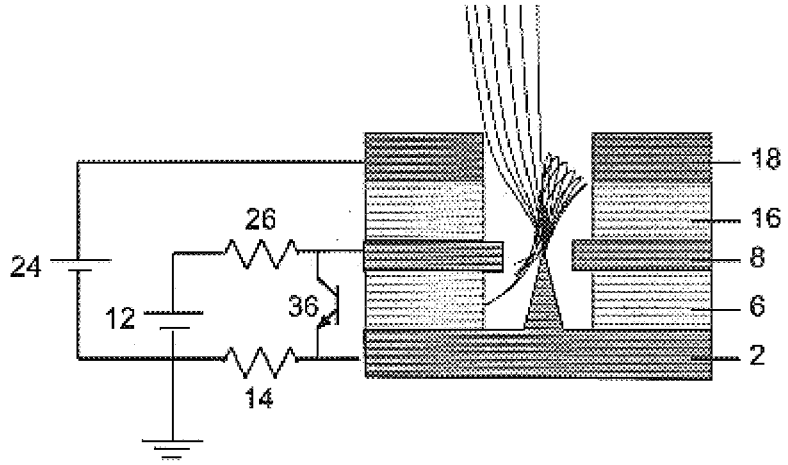

A similar transistor can be created in the alternative manner illustrated in FIG. 4*d*, wherein layer 6 is formed entirely from semiconducting material. In this configuration, it may be convenient and/or advantageous to fabricate one or more of the conductive layers 2, 8, and 18, and also possibly layer 16 from semiconducting material, with properties designed to provide electrical isolation across layers 6 and 16. In some cases the transistor may be formed across layer 16 as well as or instead of layer 6.

The filter aperture 15 and gate aperture 10 should preferably have rotational symmetry about a vertical axis, and the emission site 4 should be located on the axis of symmetry. To make the electric potential within the filter aperture 15 relatively independent of the voltage applied to other electrodes (such as gate layer 8), the filter aperture 15 should preferably have a thickness similar to or greater than the its diameter. The diameter of the filter aperture 15 should preferably be greater than the diameter of the gate aperture 10 in order to allow most of the electrons with energies above a predetermined cutoff to pass through.

Figure 4E:
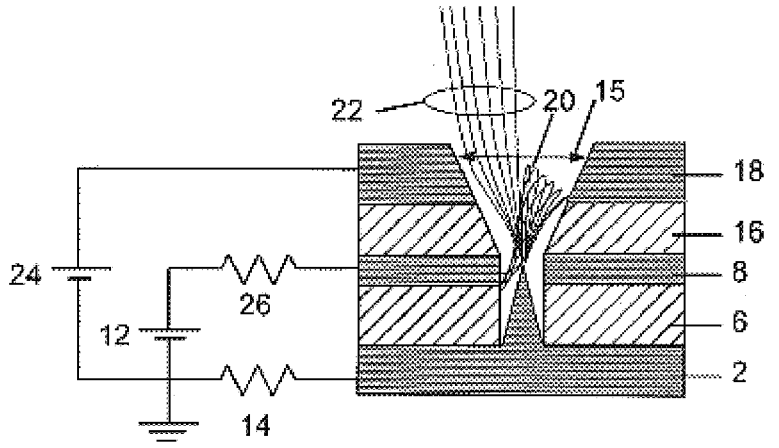
Figure 4F:
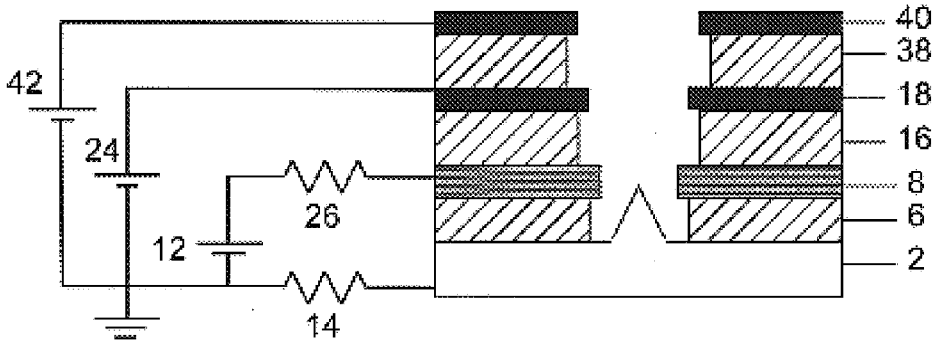

FIG. 4*e* illustrates another exemplary embodiment, where the diameter of the filter aperture 18 as well as isolation layer 16 are tapered, with larger diameter toward the top of the conductive layer 18. This arrangement may be more convenient to fabricate. Similarly, layer 18 may be implemented as two or more electrically isolated layers, such as illustrated in FIG. 4*f* by conductive layer 40 and isolation layer 38. A voltage 42 applied to layer 40 may be the same or different than voltage 24. The addition of still another isolated layer may allow further flexibility in designing the electron energy filter, and may be particularly important when the affect of the layers on the electron trajectories (electron lens properties) is also considered. The use of two or more thin conductive layers may be more compatible with some fabrication technologies than a single thick layer. The apertures in some or all of these layers may be shaped and arranged in other ways to achieve qualitatively similar results. For example, the filter aperture may be coplanar with the gate aperture. Alternatively, two or more gate apertures may be located within one large filter aperture. In this case the filter aperture might be fabricated separately and attached to an unfiltered array. Such alternative geometries may be more easily fabricated in some cases. It will be appreciated that additional circuit elements may also be provided between the voltage sources 24 and 42 and their respective apertures.

Figure 4G:
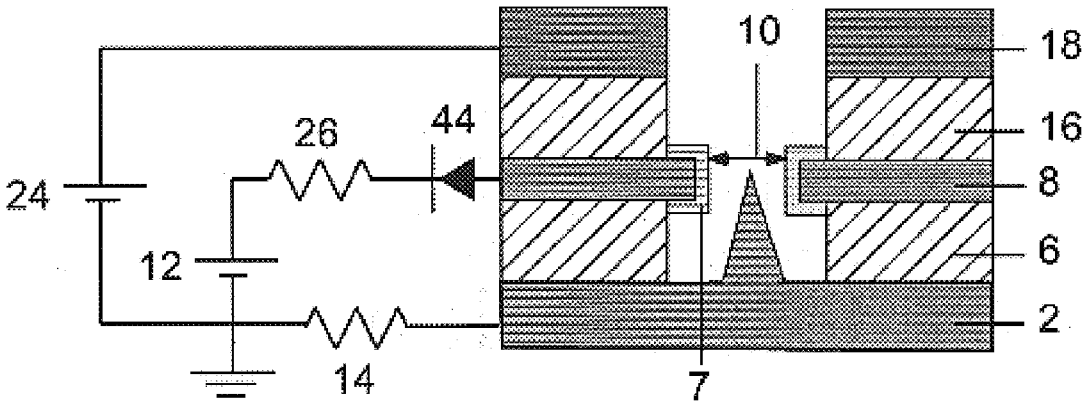

Circuit elements may be created at the exposed aperture surface of the conductive layers. This is illustrated in FIG. 4*g* wherein a material volume 7 is formed at the exposed surface of layer 8. The interface between volume 7 and layer 8 may form a diode 44 and/or increase resistance 26. For example, if layer 8 were fabricated from a lightly doped n-type semiconductor (e.g. silicon) and volume 7 was a typical metal (e.g. nickel), the interface would form a diode. The volume 7 might be fabricated, for example, by electrolytic deposition. The diode creates a voltage blocking the flow of electrons into the n-type material and reducing the electric potential at aperture 10. A capacitance will typically occur in parallel with diode 44.

Further referring to FIG. 4*g*, it will be appreciated that the maximum voltage which may be reliably developed at circuit elements such as 26 and 44, in series with aperture 10, should be nearly as large as the maximum of voltage 12. The maximum electric field inside the materials comprising circuit elements 26 and 44 is related to the geometry of the elements and the voltage across them. It is often convenient to form these high voltage circuit elements in a planar arrangement, for example extending from the aperture 10 horizontally into layer 8. In this way, the circuit elements may be annular in shape with diameters up to several microns. Such structures may be conveniently formed using diodes.

Volume 7 might be an oxidized or otherwise reacted layer of the conductive metal or semiconductor in layer 8, creating resistance 26. For example, layer 8 might be made from silicon or tantalum and oxidized to form silicon oxide or tantalum oxide.

It will further be appreciated that secondary electrons are sometimes created when electrons strike some materials. Because of the energy filter, such secondary electrons may be forced to return to layer 8, rather than escape to a remote collector as might occur without an energy filter. This is advantageous, since the current of secondary electrons can in some cases be as great (or greater) than the current of primary electrons. Thus without the energy filter, the voltage generated at the circuit elements in series with aperture 10 (e.g. 26 and 44) could in some cases be much smaller or opposite in sign to the desired voltage.

Figure 5:
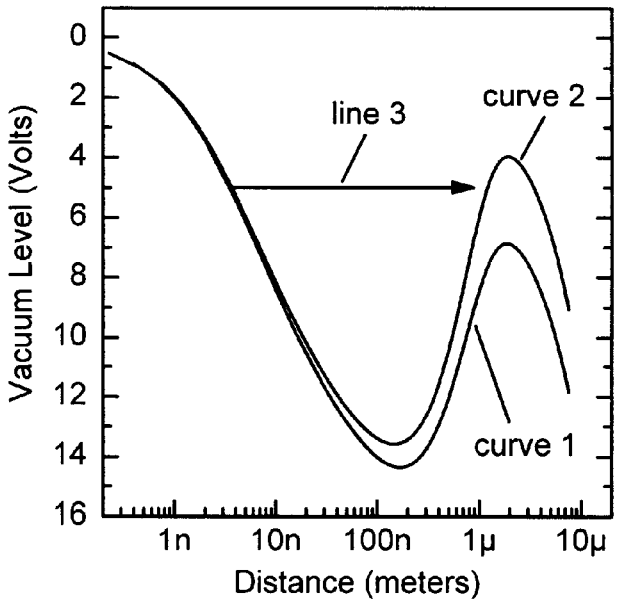
FIG. 5 shows an exemplary plot of the electric potential of an electron at rest in vacuum along the vertical axis above the field emitter within the structure shown in FIG. 4.

Referring now to FIG. 5, there is shown an exemplary graph of the electric potential of the vacuum potential (potential of an electron at rest in vacuum) calculated along the vertical axis of rotational symmetry for the example field emitter structure shown in FIG. 4. The vacuum potential is calculated assuming two different cases, where the voltage at the filter aperture 15 is: a) 6V (curve 1), or b) 3V (curve 2).

The potentials are plotted on the vertical axis with more positive values going down, since electrons with more positive potentials have lower energy. The distance from the emitter surface is plotted on a log scale on the horizontal axis. The vacuum level is referenced to zero at the emitter surface. Most of the electrons in the solid have energies below $E_F$. Electrons can tunnel into vacuum when the vacuum level is equal to the initial energy of the electron.

This occurs 3.6 nm from the emitter surface in this example, where $E_F$ is assumed to be 5 volts more positive than the vacuum level at the surface.

The total energy of the electrons remains constant as they pass through space, shown using Line 3 in FIG. 5. The electrons encounter great resistance to tunnel unless the potential barrier is very thin. Hence, when the electrons encounter the potential barrier as shown in curve 2, when the filter aperture potential is 3 V, they are reflected towards the gate layer 8. Conversely, they may pass over the lower potential barrier shown in curve 1, when the filter aperture is at 6V. Similarly, electrons with energy more than 7V positive (emitted with energies more than 2 eV below $E_F$) will be reflected towards the gate layer 8 even when the filter aperture 15 is at 6V (curve 1). By this process the system of the present invention rejects any electrons emitted below the filter cutoff energy. The desired cutoff energy may vary with the type of emitter, but it may typically be 2–3 eV below $E_F$.

Figure 6:
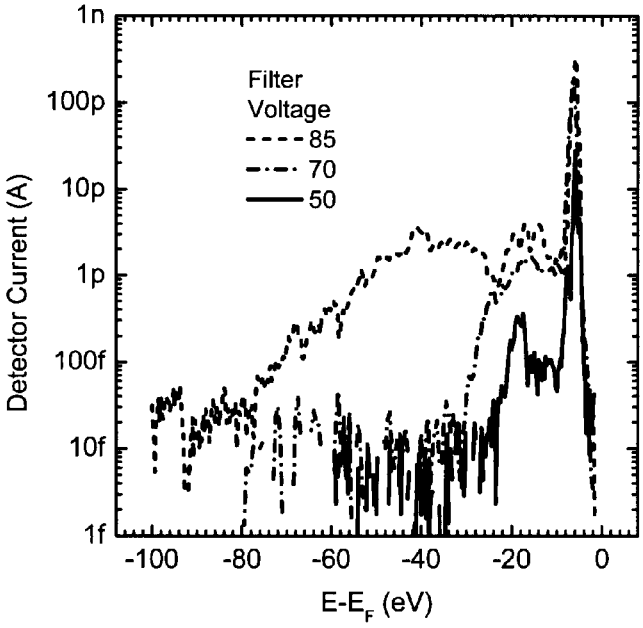
FIG. 6 shows a chart illustrating the measured energy distributions created by an example field emitter array having two apertures as shown in FIG. 4.

FIG. 6 illustrates energy distributions from an FEA having a conductive layer 18 and aperture 15 (the combination also referred to herein as an "energy filter"). The figure shows plots of the measured energy distributions created by a field emitter array having gate and filter apertures similar to those shown in FIG. 4. Three distributions are plotted, measured with the voltage source 24 held at 50, 70, and 85V, respectively. The voltage source 12 was 90V during all three measurements.

When the voltage source 24 is 85V, some electrons pass through the filter aperture 15 with energies as low as 80V below $E_F$. When the voltage 24 is reduced, the lower energy electrons no longer pass through the filter aperture 15, and hence are no longer observed in the energy spectrum. In this example, the films used to create the gate and filter apertures were resistive, and significant currents were intercepted. Thus, the actual potentials that appeared at the aperture surfaces were probably somewhat more positive than the applied potentials, explaining why the filter cutoff energies were significantly higher than the applied potentials. The filter aperture 15 should ideally not be so resistive as to cause a change in potential at its surface.

Figure 7:
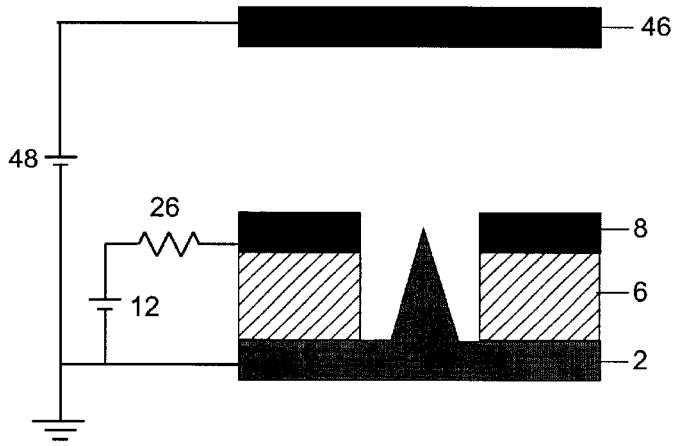
FIG. 7 shows another exemplary embodiment for creating an energy filter in accordance with another exemplary embodiment of the present invention.

FIG. 7 shows another type of filter in an alternative embodiment of the present invention. In this case, the potential of the collecting electrode 46 is used to retard the electrons, so that low energy electrons are returned to the gate layer 8. This type of filter can be created with existing FEAs lacking an integrated filter layer. However, it may be difficult to achieve local regulation at each emitter cell. The filter as shown in this embodiment was used to make the measurements illustrated in FIGS. 8*a*–8*b*, demonstrating how an energy filter in combination with a circuit regulating the gate current can be used to regulate the total emission current.

Figure 8A:
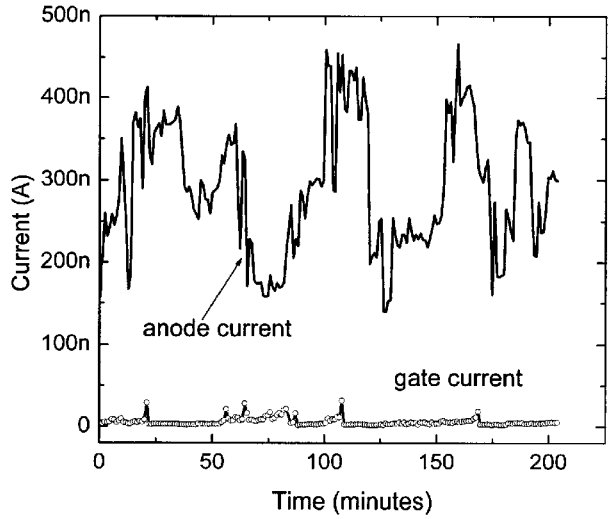
FIGS. 8*a*–8*b* show exemplary charts of anode current versus time using the filter as shown in FIG. 7.
Figure 8B:
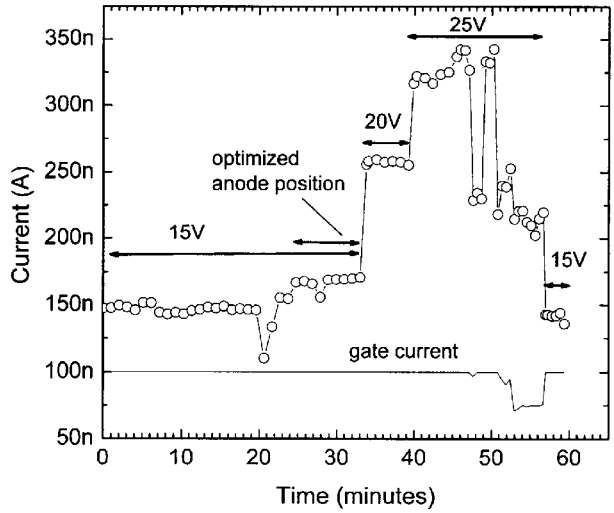

FIGS. 8*a*, 8*b* show plots of the anode current vs. time emitted by a nanotube FEA. The results show that the current varied considerably with time when the gate current was unlimited and the anode voltage was 200V positive with respect to the substrate, as shown in the plot of FIG. 8*a*). The current was stabilized as shown in FIG. 8*b* when the total gate current was regulated to be no more than 100 nA and the anode voltage was reduced to 15V. When the anode potential was increased to 25V the emission noise resumed even though the gate current was still limited to 100 nA. When a filter is implemented in this configuration, the anode current was found to be sensitive to the anode position, as shown in FIG. 8*b*.

The energy filter may also be used with other alternative types of electron emitters, different from field emitters. The currents produced by alternative emitters such as graded electron affinity structures, forward biased n-p junctions, or photo-emitters may also be sensitive to the large electric fields which can be produced by the first (gate) aperture, and may also produce emission at increasingly positive energies as the emission current increases. In such cases, the energy filter and appropriate feedback circuits can be used in like manner as with the field emitter structures described above. When these alternative types of electron emitters are used, the purpose of the feedback circuit may be different. In cases where the emission current is not sensitive to the external field, the emission energy distribution and emission current can still be modified by use of the energy filter. An array of filter apertures may be integrated onto the cathode surface in any case where the operating temperature of the cathode is compatible with such integrated structures.

While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A cathode apparatus capable of regulating current, comprising:

a first electrode, with at least one aperture therein, arranged on a substrate;

an emitter structure formed on the substrate for injecting current when a voltage supply is connected between the first electrode and the substrate;

a second electrode arranged above or adjacent to the first electrode, wherein electrons failing to pass through the second electrode are collected by said first electrode; and a feedback circuit connected to said first electrode for reducing the voltage applied to said first electrode in response to the electrons collected by said first electrode.

2. The apparatus as in claim 1, wherein said second electrode includes at least one aperture therein.

3. The apparatus as in claim 1, wherein potentials applied to the second electrode are controlled so as to prevent electrons having energies below a cutoff value from passing through the aperture of the second electrode.

4. The apparatus as in claim 1, wherein said cathode is the field emission cathode.

5. The apparatus as in claim 2, wherein the aperture diameter of said second electrode is greater than the aperture diameter of said first electrode.

6. The apparatus as in claim 1, wherein current entering the first electrode as a result of the second electrode is used as the feedback signal to control the electric potential at the at least one aperture in said first electrode and thereby controlling emission current.

7. The apparatus as in claim 2, wherein the aperture in the second electrode is placed co-axially with the aperture in the first electrode.

8. The apparatus as in claim 2, wherein the aperture in the second electrode is electrically isolated from the aperture in the first electrode in order to create an electric potential that is dissimilar to gate electric potential.

9. The apparatus as in claim 2, wherein the second electrode and the aperture therein form a high pass energy filter for a charged particle beam.

10. The apparatus as in claim 1, wherein said second electrode and said feedback circuit reduce the energy spread of electrons generated by said emitter structure.

11. A cathode apparatus, comprising:

a gate electrode, with at least one aperture therein, is arranged on a substrate;

an emitter structure formed on the substrate for injecting current when a voltage supply is connected between the gate electrode and the substrate;

a filter electrode arranged above or adjacent to said gate electrode, for reflecting electrons having energies below a predetermined level for collection by said first electrode; and a feedback circuit connected to said first electrode for reducing the voltage applied to said first electrode in response to the electrons collected by said first electrode.

12. The apparatus as in claim 11, wherein said filter electrode includes at least one aperture therein.

13. The apparatus as in claim 11, wherein an energy filter for reflecting electrons is created by reducing the voltage of the filter electrode such that the filter electrode is not sufficiently positive to allow transmission of electrons emitted from low energies; and wherein said cathode is the field emission cathode.

14. A method of regulating current emitted from a cathode, the method comprising:

arranging a first electrode, with at least one aperture therein, on a substrate;

forming an emitter structure on the substrate for injecting current when a voltage supply is connected between the first electrode and the substrate;

arranging a second electrode above or adjacent to the first electrode;

collecting electrons failing to pass through the second electrode by said first electrode; and connecting a feedback circuit to said first electrode for reducing the voltage applied to said first electrode in response to the electrons collected by said first electrode.

15. The method as in claim 14, further comprising:

providing said second electrode with at least one aperture therein.

16. The method as in claim 14, further comprising:

controlling a potential applied to the second electrode so as to prevent electrons having energies below a cutoff value from passing through the aperture of the second electrode.

17. The method as in claim 16, further comprising:

depositing a layer of semiconducting material on an exposed surface of the dielectric layer.

18. The method as in claim 14, further comprising:

providing a semiconducting layer between the substrate and the first electrode.

19. The method as in claim 14, further comprising:

providing a semiconducting layer between the first and second electrodes.

20. The method as in claim 15, wherein:

aperture diameter of said second electrode is greater than the aperture diameter of said first electrode; and the second electrode is held at a positive potential that is lower than a potential applied to the first electrode.

21. The method as in claim 15, further comprising:

using additional current collected at the first electrode resulting from the action of the second electrode as a signal in the feedback circuit, thereby controlling the electric potential at the first electrode and hence the emission current.

22. The method as in claim 21 further comprising:

arranging the aperture in the second electrode to be coaxial with the aperture in the first electrode.

23. The method as in claim 22, further comprising:

electrically isolating the aperture in the second electrode from the aperture in the first electrode in order to create the electric potential that is dissimilar to gate electric potential.

24. The method as in claim 14, wherein the second electrode and the aperture therein, form a high pass energy filter for a charged particle beam; and wherein said cathode is the field emission cathode.

25. The method as in claim 14, wherein the energy spread of electrons generated by said emitter structure is reduced using said second electrode and said feedback circuit.

26. A method of reducing beam current in a cathode, comprising:

forming a gate electrode, with at least one aperture therein, on a substrate;

forming an emitter structure on the substrate for injecting current;

forming an energy filter electrode above or adjacent to said gate electrode, for reflecting electrons having energies below a predetermined level;

collecting electrons reflected by said energy filter electrode at said first electrode; and connecting a feedback circuit to said first electrode for reducing the voltage applied to said first electrode in response to the electrons collected by said first electrode.

27. The method as in claim 26, further comprising:

providing said filter electrode with at least one aperture therein.

28. The method as in claim 26, further comprising:

creating an energy filter for reflecting electrons by reducing the voltage of the filter electrode so as to prevent collection of electrons emitted from low energies.

29. The method as in claim 26, further comprising:

using an energy filter in combination with a current-sensitive element in series with the emitter structure in order to allow the voltage produced at the current-sensitive element to be unrelated to the voltage at the gate electrode.

30. The method as in claim 26, wherein:

the current-sensitive element is a resistor;

the filter electrode is held at a positive potential that is lower than the potential applied to the gate electrode; and said cathode is the field emission cathode.

31. In a cathode device having a gate electrode with a gate aperture therein, an emitter structure, a filter electrode, and a feedback circuit connected to the gate electrode, a method of improving the performance of the field emission cathode comprising:

detecting emission of electrons having energies less than a predetermined cutoff level;

adjusting a potential applied to the filter electrode so as to prevent electrons having energies less than the predetermined cutoff level from clearing the potential barrier of the filter electrode;

deflecting electrons having energies less than the predetermined cutoff level towards the gate electrode;

collecting the deflected electrons at the gate electrode; and using the feedback circuit connected to said gate electrode for reducing the electric potential appearing at the gate electrode in response to occurrence of excessive emission below the cutoff level.

32. The method as in claim 31, further comprising:

providing said filter electrode with at least one filter aperture therein.

33. The method as in claim 32, wherein emission below the cutoff level fails to pass through the filter aperture and is collected by the gate electrode.

34. The method as in claim 32, wherein emission below the cutoff level is reflected from the filter electrode and is collected by the gate electrode.

35. The method as in claim 31, wherein:

the filter electrode is held at the positive potential that is lower than the potential applied to the gate electrode; and said cathode is the field emission cathode.

36. The method as in claim 32, wherein:

filter properties are determined by physical dimensions of the filter aperture, the filter electrode, and the gate electrode.

37. An apparatus for improving the performance of a cathode, comprising:

a filter electrode for detecting the emission of electrons having energies less than a predetermined cutoff level;

means for adjusting the potentials applied to the filter electrode so as to prevent electrons having energies less than the predetermined cutoff level from passing through an aperture in the filter electrode;

means for deflecting electrons having energies less than the predetermined cutoff level towards a gate electrode;

means for collecting the deflected electrons; and means for reducing the voltage applied to the gate electrode in response to collection of electrons at the gate electrode.

38. A cathode apparatus capable of regulating current, comprising:

a first electrode, with at least one aperture therein, arranged on a substrate;

an emitter structure formed on the substrate for injecting current when a voltage supply is connected between the first electrode and the substrate;

a plurality of filter electrodes, wherein electrons failing to pass through said filter electrodes are collected by said first electrode; and a feedback circuit connected to said first electrode for reducing the voltage applied to said first electrode in response to the electrons collected by said first electrode.

39. The apparatus as in claim 38, wherein each filter electrode includes at least one aperture therein.

40. The apparatus as in claim 38, wherein each filter electrode is held at a different potential and electrically isolated from other filter electrodes; and said cathode is the field emission cathode.

* * * * *